United States Patent [19]

Shepherd et al.

[11] 4,422,580

[45] Dec. 27, 1983

[54] MACERATOR PUMPING IMPELLER

[75] Inventors: Nigel R. C. Shepherd, Ross-on-Wye; Graham M. Preece, Checkley, both of England

[73] Assignee: The Haigh Engineering Co. Ltd., United Kingdom

[21] Appl. No.: 272,023

[22] Filed: Jun. 9, 1981

[30] Foreign Application Priority Data

Jun. 11, 1980 [GB] United Kingdom ..... 8019074

[51] Int. Cl.[3] ..... B02C 23/36

[52] U.S. Cl. ..... 241/46.11; 241/46.17

[58] Field of Search ..... 241/46.11, 46.17, 55, 241/56; 415/121 B

[56] References Cited

U.S. PATENT DOCUMENTS

| | | | |
|---|---|---|---|
| 2,682,376 | 6/1954 | Frank | 241/46.11 X |
| 2,947,486 | 8/1960 | Higer | 241/46.11 X |
| 3,083,922 | 4/1963 | Enright et al. | 241/46.11 X |

*Primary Examiner*—Mark Rosenbaum

*Attorney, Agent, or Firm*—Wellington M. Manning, Jr.; Luke J. Wilburn, Jr.

[57] ABSTRACT

A macerator is disclosed which has an impeller which on its upstream side is provided with radial fins adjacent fixed teeth and through which a number of slots pass. On its downstream side an outwardly flared member is provided with radial vanes. Effluent entering the macerator is thrown by the fins onto the teeth and can than pass through the slots to be thrown outwardly by the member and then to the macerator outlet. The provision of the member provides a significant pumping effect.

5 Claims, 1 Drawing Figure

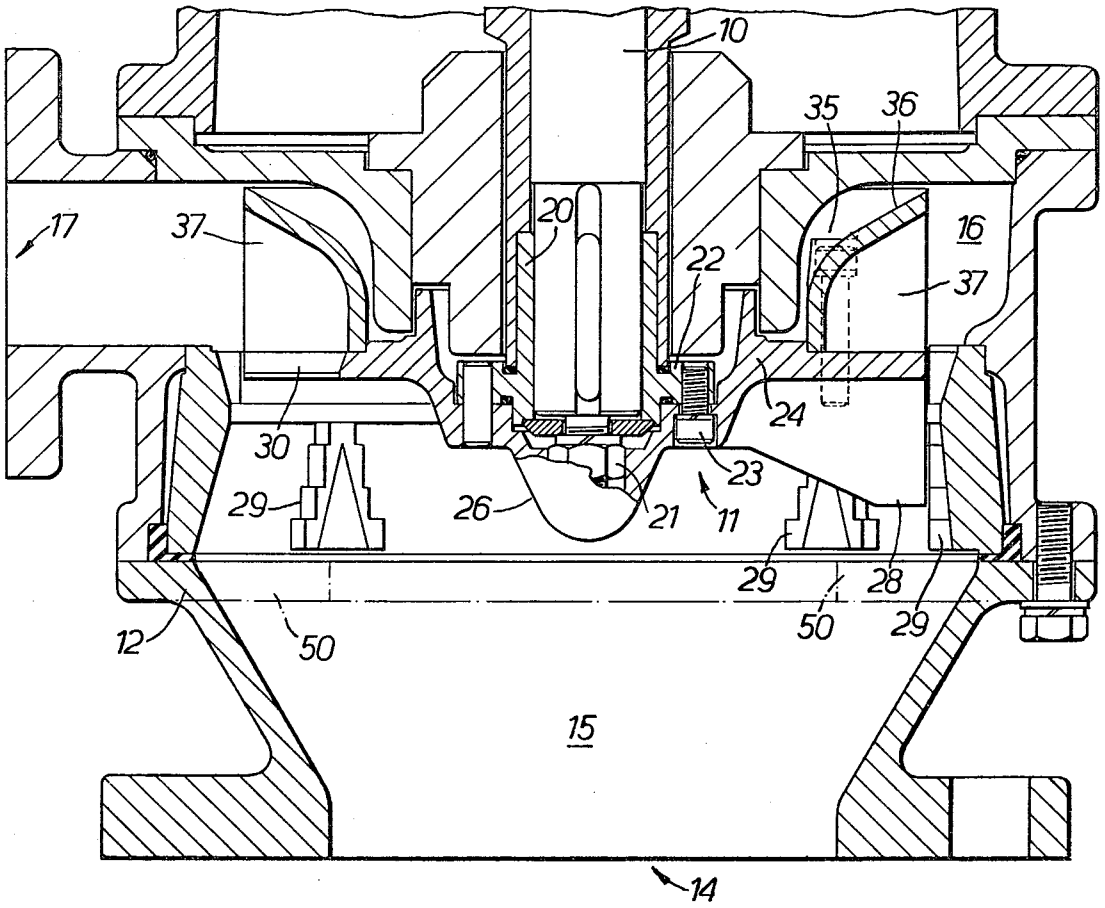
10
17
37
35
36
16
37
22
20
24
23
11
21
26
30
29
28
29
29
50
50
12
15
14

MACERATOR PUMPING IMPELLER

This invention is concerned with macerators.

The normal design of a macerator includes a rotating impeller which acts on an effluent containing liquid to project the effluent radially onto a fixed ring of teeth where the effluent is macerated between the teeth and vanes on the upstream side of the impeller. The liquid and macerated effluent flow through slots in the impeller to the discharge from the macerator.

As macerator impellers are generally bi-rotational to prevent clogging of the teeth the vanes on the impeller are not shaped as, for example, those in centrifugal pumps, and consequently have little or no pumping effect on the liquid and macerated effluent. Flow through the macerator is thus provided by some means external to the macerator.

It is an object of the present invention to provide a macerator having an impeller which has a significant pumping effect.

The present invention is a macerator including a casing in which is mounted an impeller having at least one slot passing axially therethrough and which has on its upstream side upstanding fins and on its downstream side an outwardly flared annular member on which is mounted a number of external radial vanes.

Preferably the flared annular member is surrounded by a circumferential cavity in the casing of the macerator, from which cavity the macerator discharge leads.

An embodiment of the present invention will now be described, by way of example, with reference to the accompanying drawing which is an axial section through the impeller region of a macerator according to the present invention.

Referring now to the drawing, a macerator is provided with a drive motor (not shown) mounted above and driving a shaft 10 to which is keyed an impeller 11. The impeller is rotatable in a lower casing member 12 between an inlet chamber 15, with which the macerator inlet 14 communicates, beneath the impeller and a circumferential discharge chamber 16 from which the discharge 17 of the macerator leads.

The impeller comprises a central spigot 20 which is keyed to the shaft 10 and secured in position by an axial bolt 21. The spigot 20 is provided with an external flange 22 to which is secured, by recessed bolts 23, the impeller plate 24 which has a central dome 26 covering the bolt 21 and preventing any long fibrous material in the effluent from building up around the bolt 21. Conventional radial fins 28 extend from the upstream face of the impeller plate 24 and cooperate with fixed teeth 29 to macerate the effluent. The plate 24 is also provided with a number of radial slots 30 which allow the effluent liquid and macerated solids to flow through the macerator plate.

On the downstream face of the impeller is secured, by means of bolts 35, an outwardly flared annular member or finger plate 36 from which a number of radial vanes 37 extend to the impeller plate 24. The number and spacing of the vanes 37 depends upon the number and spacing of the slots 30 in the impeller plate, but typically there is an equal number of vanes and slots. The discharge chamber 16 surrounds the member 36.

In use, the effluent enters the macerator at the inlet 14 and in the inlet chamber 15 on the upstream side of the macerator is thrown by the impeller fins 28 against the fixed teeth 29. The macerated effluent then passes through the slots 30 in the impeller plate to be acted upon by the finger plate 36 and projected radially into the chamber 16 and thence to the discharge from the macerator. The radial projection afforded by the member 36 produces a significant pumping effect and draws effluent from the inlet chamber. In particular it should be noted that the effect is independent of the direction of rotation of the impeller, i.e. the impeller is bi-directional.

It should also be noted that the upstream face of the impeller plate, i.e. the face to which the finger plate 36 is secured, may be machined to give a variety of thicknesses of the plate, this effectively altering the height of the member 36 in the chamber 16 and thus its pumping characteristics, allowing adjustment of the impeller to relate its characteristics to the viscosity of the effluent and the desired throughput.

In a modified embodiment the inlet chamber 15 is dispensed with and instead an annular plate 50 is secured beneath the teeth 29 as indicated by the dotted lines in the drawing. The central aperture of the plate is the same diameter as the inlet 14, i.e. the diameter of the inlet pipe and this, as can be seen from the drawing, is less than the diameter of the ring of teeth 29. It has been found that this further improves the pumping ability of the macerator in the range in which the finger plate is especially effective, e.g. when the inlet liquid contains more than 20% solids.

We claim:

1. A macerator including a casing, a shaft mounted in said casing, an impeller mounted on the shaft and having at least one slot passing axially therethrough, said impeller having has on its upstream side upstanding fins and on its downstream side an outwardly flared annular member on which is mounted a number of external radial vanes, said casing and said impeller defining a discharge chamber about said outwardly flared annular member, said discharge chamber being sized with respect to said annular member such that rotation of said annular member therein creates a pumping effect on effluent in said discharge chamber and on effluent upstream of said impeller adequate to draw further effluent through said at least one slot.

2. A macerator as claimed in claim 1, in which the flared annular member is surrounded by a circumferential cavity in the casing of the macerator, from which cavity the macerator discharge leads.

3. A macerator as claimed in claim 2, including a ring of teeth disposed outwardly of said fins, the diameter of the macerator inlet being less than the diameter of said ring of teeth.

4. A macerator as claimed in claim 3, including an inlet chamber between the inlet and said ring of teeth.

5. A macerator comprising:

(a) a casing defining an effluent inlet opening and a macerated effluent outlet opening, said casing having macerating means rigidly located around an inside of same;

(b) macerator drive means associated with said casing and including a drive shaft located within said casing, axial thereto;

(c) an impeller received within said casing between said inlet and outlet openings and mounted on said drive shaft, said impeller including a plurality of upstanding fins located on an upstream side of same and at least one flared annular member extending outwardly from a downstream side of same, said impeller defining at least one effluent discharge slot axially therethrough, said casing and said impeller defining a discharge chamber about said outwardly flared annular member said discharge chamber being sized with respect to said annular member such that rotation of said annular member therein creates a pumping effect on effluent in said discharge chamber and on effluent upstream of said impeller adequate to draw further effluent through said at least one slot.

* * * * *